United States Patent [19]

Young

[11] 4,454,425

[45] Jun. 12, 1984

[54] PHOTOIONIZER

[76] Inventor: Robert A. Young, 9773 Variel Ave., Chatsworth, Calif. 91311

[21] Appl. No.: 500,644

[22] Filed: Jun. 2, 1983

Related U.S. Application Data

[63] Continuation-in-part of Ser. No. 259,230, Apr. 30, 1981, abandoned, which is a continuation-in-part of Ser. No. 238,275, Feb. 25, 1981, Pat. No. 4,377,749.

[51] Int. Cl.[3] ..... H01J 27/00

[52] U.S. Cl. ..... 250/423 P

[58] Field of Search ..... 250/423 P, 281, 282, 250/283; 313/184

[56] References Cited

U.S. PATENT DOCUMENTS

| | | | |
|---|---|---|---|
| 3,476,968 | 11/1969 | Omura | 250/423 P |
| 3,478,204 | 11/1969 | Brubaker et al. | 250/423 P |
| 4,000,420 | 12/1976 | Harris | 250/423 P |

*Primary Examiner*—Bruce C. Anderson

*Attorney, Agent, or Firm*—John E. Benoit

[57] ABSTRACT

There is provided a photoionizer which includes a light source comprising a hollow torus, an ultraviolet transmitting window substantially surrounding a passage through the torus, a gas filling within the torus, and means for creating an electrical discharge within said torus. The photoionizer further includes an electrode means within said passage through said torus for collecting, or extracting, the ions produced by the said light source striking a gas within said passage, means for passing a preselected gas sample through said passage containing said electrode means, and means connected to said electrode means for measuring the ions collected by said electrode means resulting from the interaction between said light source and said gas sample or extracting means able to project a beam of ions from the ionization region or from an ion image outside the ionization region. Means are also provided for either intercepting or measuring surface currents.

5 Claims, 12 Drawing Figures

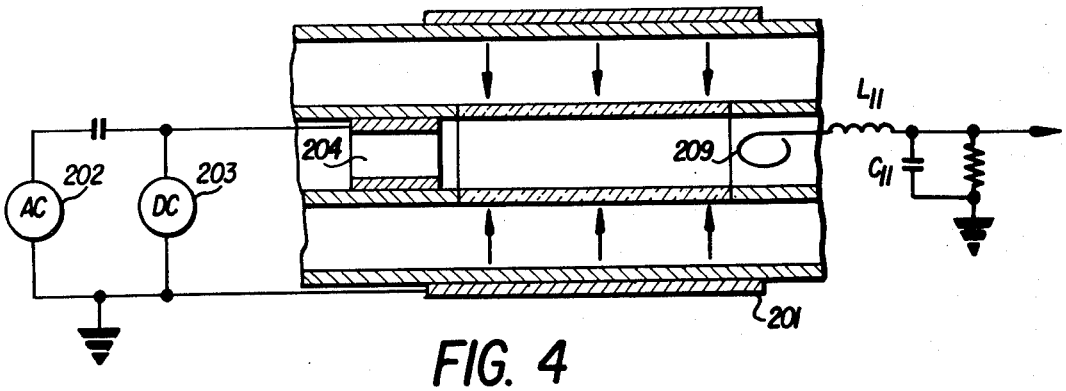
FIG. 4
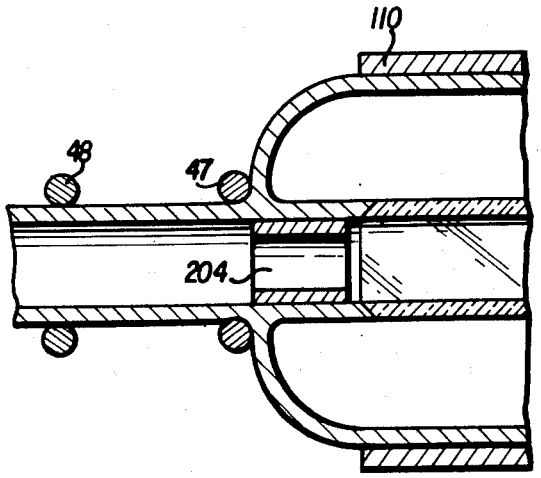
FIG. 5
FIG. 6
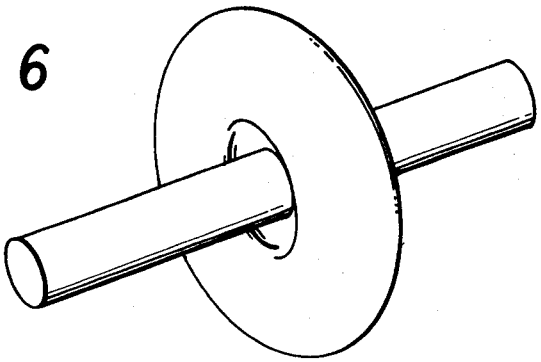

PHOTOIONIZER

The present invention is a continuation-in-part application of U.S. patent application Ser. No. 259,230, filed Apr. 30, 1981 in the name of Robert A. Young abandoned which is a continuation-in-part application of U.S. patent application Ser. No. 238,275, filed Feb. 25, 1981 now U.S. Pat. No. 4,377,749 which relates generally to a photoionizer and more specifically to a photoionization detector of trace species which uses a sealed light source in the detector and a photoionization source for a mass spectrometer which uses the same light source.

BACKGROUND OF THE INVENTION

The use of sealed light sources for various purposes is discussed and illustrated in U.S. Pat. Nos. 3,902,064, 3,902,808, 3,904,907, 3,946,235 3,946,272, 3,984,727, 4,002,922 and 4,024,131 as well as other patents which all issued in the name of the present inventor. Reference is hereby made to these patents for background information relative to the basic operation of such lamps.

In the present invention, the type of lamp generally shown in the above-identified patents is modified so that the central hollow dielectric electrode which has one end enclosed is modified to extend completely through the lamp bulb. Accordingly, the front window which exists in the referenced patents is not used in the present invention. It is effectively replaced by a cylindrical window which will be described below. In the present application, the use of the word "torus" will be basically understood from the dictionary definition which refers to the surface of a solid shape which is normally formed by a revolving plane closed curve about a line in its plane. The structure forming the torus may be shaped by continuous (but not uniform) deformation such that it can be transformed into a torus whose enclosed cross section can be outlined by any plain curve, with or without a tube connecting to the inner wall of the torus.

BRIEF DESCRIPTION OF THE DRAWINGS

FIG. 4 is a schematic illustration of a modified electrode configuration;

FIG. 5 is a partial cutaway schematic of a modification of the device of FIG. 1;

FIG. 6 is an illustration of a further shape which may be assumed by the torus of the present invention;

BRIEF DESCRIPTION OF THE INVENTION

Figure 1:
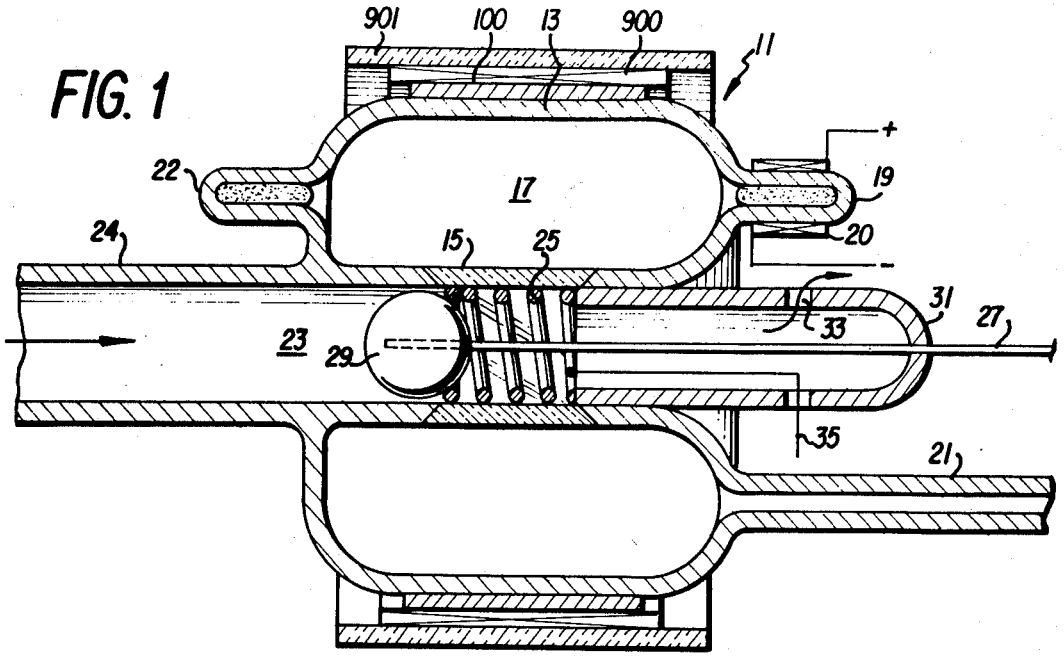
FIG. 1 is a schematic illustration of one embodiment of the invention.

The present invention provides a photoionizer which includes a light source comprising a hollow torus, an ultraviolet transmitting window substantially surrounding a passage through the torus, a gas filling within the torus, and means for creating an electrical discharge within said torus. It further includes an electrode means within said passage through said torus for collecting, or extracting, the ions produced by the said light source striking a gas within said passage, means for passing a preselected gas sample through said passage containing said electrode means, and means connected to said electrode means for measuring the interaction between said light source and said gas sample or extracting means able to project a beam of ions from the ionization region to an ion image outside the ionization region.

Electrodes occur in pairs between which a potential difference is applied. In one case, an AC potential difference is applied to cause a discharge in the gas in the photoionization light source and in another case, a stable, or slowly varying, potential (relative to that causing a discharge) is applied to electrodes to collect or extract ions from a region near the light source window. These electrodes may be physically different, or one electrode of the AC potential pair may be composed of a physically distant pair between which a stable or slowly varying potential is applied while both are at nearly the same AC potential. In addition, the electrodes may perform other functions such as securing the light source or heating the light source.

The photoionizer is operated in two modes; (1) when the gas sample being ionized is at high density so that the resulting ions have a mean free path smaller than a typical dimension of the ionization region, and (2) when the gas pressure is small such that the ion mean free path is large relative to a typical dimension of the dimension region. Ions are collected at high sample pressure and the device is used to measure the amount of parent gas in the sample from which ions are made by photoionization. At low pressure, the ions are extracted from the ionization region and projected or focused through an aperture for analysis and measurement as by a mass spectrometer or other means.

In the use of this photoionizer, it is essential that ionizable species be introduced into the ionizing region. Some of these species, both in their natural and ionized form, become attached to the surface of the ionizer and its electrode structure. Often these react to form more complex species (such as crosslinked polymers), which are not subsequently released and flushed out of the ionizer. These residues form films which absorb the photoionization light and insulate the conducting surfaces of the electrodes. Both are undesirable, because they decrease the efficiency of the ionizer and increase its instabilities.

These films are often insoluable in ordinary solvents and are difficult to remove. However, they do react with free radicals such as O, $O_3$, H, OH, and others to form various gaseous products. In this way, complex hydrocarbons are removed as CO, $CO_2$, OH, etc. when O is present and as CH, $CH_2$, $H_2$, etc. when H is present.

The free radicals O, and H are easily produced by photolysis of oxygen and $H_2O$ by the photoionization radiation from the lamp, or by an electrical discharge produced in the gas which flows through the ionization region. Special provision can be made for this to occur by properly placing electrodes in or near the gas in the ionization region and by adding special cleaning gases containing $O_2$ and/or $H_2O$ or other simple compounds which will break down into free radicals.

To insure that the free radicals react with the surface films, it may be required to reduce or increase the density of the gas in the ionization region or to dilute the species from which radicals are generated with a non-reactive gas, such as a rare gas.

There are occasions when the ionizable constituents (or other species associated with these ionizable constituents) have a low, vapor pressure. To prevent them from condensing on the elements of the ionizer, the elements must be heated, perhaps to 300° C. This can be accomplished by utilizing some of the electrodes already present or by mounting the ionizer within a heated and thermally insulated region. Provision for this is also made without interfering with the normal operation of the ionizer.

It is imperative that only photoionization occurs in the region from which ions are extracted or collected. To insure this, there must not be large fields in this region. The DC, or slowly varying ion collection potentials are, hence, small enough such that electrons or ions produced by photoionization are not accelerated to high enough energy to cause additional ionization by collision. When the ion collection electrodes are also used as the high voltage AC electrode for causing a discharge in the torus, it is essential that they be at the same high AC potential so as not to cause a large field inside the ion collection region. In addition, these electrodes must be so located near the dielectric envelope and far from other electrodes near the photoionization region, that the high AC fields are located inside the torus or in a region outside that from which ions are collected.

All material is conductive, insulator or not and all surfaces conduct electric current. Such a basic physical fact is known and understood in all of the arts of electrical conductivity. For example, commercial electrometers, such as Keithley Instruments, Model 610C, incorporates special circuits to operate guard electrodes to intercept surface currents. This device is thoroughly discussed in its accompanying instruction manual. Texts on general experimental techniques such as "Procedures in Experimental Physics" by John Strong, Prentice Hall Inc., Inglewood Cliffs, N.J. 1938; Chapter 6: Electrometers and Electroscopes, pps. 217–259; and "The Physics of Experimental Methods", by H. J. J. Braddick, Reinhold Publishing Corporation, New York, N.Y. 1963, Chapter 6 which also discusses surface currents in guard electrodes.

Experimentation has indicated that some materials become conductive when illuminated by UV or VUV radiation and in some instances this conductivity is a function of the concentration of ionizable species present in a fluid in contact with the material surface. This can produce a surface current to the electrodes (if they are in contact with such material) which are meant to collect ions produced in the gas by photoionization and so distort these measurements or contribute noise or offsets to them.

It is clear that the surface conductivity and hence the surface current increases as the length between electrodes in contact with the surface decreases and as the length of the surface perpendicular to the applied field increase. However, the current derived from the ionization within the volume bounded by the surface photoconductor increases as this volume increases. The volume increase on the square of the length of the surface perpendicular to the applied electric field and so more rapidly than does the surface current while the volume ion current increases with an increase in surface length while the surface currents decrease. Hence, a large and long photoionization region favors volume currents relative to surface currents while short and small ionization volume favor surface currents relative to volume currents.

However, surface currents can be eliminated by means which either intercept or interrupt the surface currents by guard rings or non-conductive segments of the surface such that the surface currents are not measured by the electrodes intended to measure the rate of ion production in the fluid itself.

Part of the surface conduction path can be rendered non-conductive either by shielding it from UV or VUV radiation or by making a portion of this path of a material which does not show this photoconductivity effect. Alternatively, the ion collection electrodes may be mounted so as to make the surface conductive path very long and of small cross-section so as to decrease its conductivity to negligable importance.

For alternative measurements, it may be desireable to favor the surface currents so that they may be used to measure the concentration of constituents in a fluid. In this method, the ionization volume is purposely made small in cross-section and short in length. Otherwise, this device can be identical to that discussed here except provisions to suppress or divert the surface currents are not employed. In fact when a guard electrode is employed in this configuration to divert surface currents from the volume ionization device, this same device can be used to measure the constituents in a fluid by surface current measurements and to divert volume ionization currents from the current measuring device by connecting the current measuring device to the guard electrode and using the volume current electrode to shunt the volume ion currents around this detector.

When the electrodes used to collect ions produced from a weakly ionized gas are such that the electrodes do not "see" each other, because of an intervening dielectric "screen", it has been found that the measured current, I, is proportional to the applied voltage, V, between the electrodes. This behavior is characteristic of a resistor of resistance R, just as in ohms law, $V=IR$. In the geometry of this invention, it is observed that $R^{-1}$ is approximately proportional to the rate of ionization occuring in the region between the electrodes. Since this rate is proportional to the density of ionizable species, along with other factors, a measure of I/V, or of I since V is fixed, constitutes a measure of the amount of ionizable species present in the ionizing region. This phenomenon has the characteristics of a surface conductivity effect, but is not. This mode of operation can be prevented by removing the dielectric screen.

One physical device can be used to measure the concentration of an ionizable specie in a fluid either by surface conductivity while bypassing volume ionization currents or by measuring volume ionization currents while bypassing surface currents. It is also possible, by a choice of geometry, to measure the concentration of an ionizable specie in a fluid above some level (for example, 10 ppb) by volume photoionization current measurement and below this level by surface photoconductive current measurements.

DETAILED DESCRIPTION OF THE INVENTION

Turning now more specifically to the drawings, there is shown in FIG. 1 lamp 11 consisting of a torus 13 as defined and having a UV or VUV transmitting window 15 which is part of the central inner wall of the torus. The torus is hollow and includes a gas filling 17 and may have a gas source side arm 19 with an associated heating means 20 and a second side arm 22 containing a gettering material. There is also shown a pump stem 21 which is used to fill the torus with the particular design gas filling and which is subsequently sealed off after such filling process is complete.

If required, heater 900 in conjunction with insulation 901 can be used to maintain the ionizer at an elevated temperature.

In the embodiment shown in FIG. 1, a passage 23 is created by means of molding a wall 24 so as to conform to the inner passage of the torus. As shown, UV or VUV transparent material 15 is secured so as to form a section of the inner wall of the torus. Electrode structure 25, consisting of a cylindrical metal element, is secured adjacent said transparent material and is designed so as to have many openings. Element 25, as shown in the embodiment in FIG. 1, is a helical spring. However, it should be noted that a metal mesh could be used as well as a deposited electrode structure. Such structure will be referred to hereinafter as a semi-transparent electrode.

A thin central electrode 27 passes centrally through the passage 23 and is substantially aligned in the axis of such passage. The two electrodes 27 and 25 are electrically insulated from one another.

In the embodiment shown in FIG. 1, electrode 27 is maintained in the passage by means such as a glass ball 29 in which the electrode 27 is imbedded. Electrode 27 also passes through a spring compression unit 31 whereby the compression unit is adjusted within passage 23 so as to maintain the ball 29 nestled firmly against helical electrode 25 and also to maintain electrode 27 under tension. Spring compression unit 31 has passages 33 therethrough so that the gas may pass outwardly therefrom and, additionally, so that the outer electrode lead 35 may be passed outwardly from the detector. Electrode 100, in contact with the outer wall of the torus, holds the torus and is an electrical conductor at AC and DC ground.

This electrode structure has two functions: First, it acts as a high AC voltage electrode to cause a discharge, preferably in the range of 50 KHz and 5000 MHz, between electrode 25 and electrode 100 in the torus which surrounds it and, secondly, it collects positive ions on the central electrode which are formed in the gas passing through the passage 23 by optical radiation from the discharge in the torus.

Figure 2:
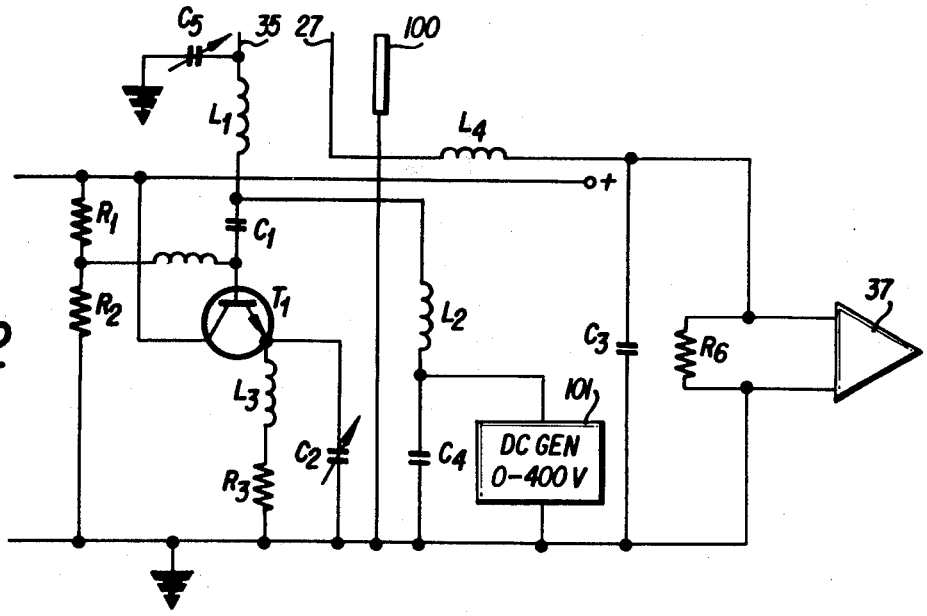
FIG. 2 is a schematic diagram of the detecting circuit used relative to the output of FIG. 1.

FIG. 2 illustrates the circuitry used for accomplishing this purpose. Outer electrode 25 is connected to an AC resonance circuit 35 comprised of capacitor C5 and coil L1 as is the standard procedure in the above-identified patents. In the present useage, the circuit is modified whereby DC decoupling capacitor C1 is used so that the outer conductor 25 and the series resonant circuit composed of C5 and L1 can have an arbitrary DC voltage impressed upon it. This coil L2 and capacitor C4 which, together with the use of capacitor C1, isolates the RF and DC circuits. Central electrode 27 is connected to an electrometer circuit 37 which includes resistor R6. This connection is made through coil L4, and the RF voltage is filtered out by coil L5 and capacitor C3. Positive ions are collected on the central electrode where they are neutralized by electrons which pass from ground through resistance R6 of the electrometer, with the electrometer measuring the current which equals the rate of positive ion collection by the central electrode and, thus, relates to the amount of the particular ionizable gas which is passed through passage 23.

An unwanted background is produced by electrons ejected from the conductive electrodes. Since the outer electrode is positive, any electrons ejected from it are collected by it and no current flows in the exterior circuit. However, electrons ejected from the negative central electrode move to the outer electrode and are therefore measured by the electrometer. This unwanted current may be minimized by making the central electrode wire as small as 0.001 inches in diameter so as to minimize the area from which electrons can be ejected compared to the volume of gas from which positive ions may be collected.

The above configuration of the torus and the arrangement of the electrodes together with the circuitry has the following advantages. (1) The UV or VUV radiation from the bulb which surrounds the ionization region is efficiently coupled into that region. (2) The volume of this region is all effectively used and can be made small. (3) Photoelectron currents are made small due to the small area of the negative electrode. (4) Excitation of the dischare is effective, as is ion collection, while both use some of the same electrode structure. (5) Gas passage through the ionization region is direct and simple.

In a slightly altered configuration the AC connections to electrode 25, via connector 35, is removed and connection 35 attached directly to DC generator 101 which is shunted by C4 so that electrode 25 is at AC ground, but at an arbitrary DC potential, and electrode 100 is connected to the juncture between C4 and L1 where connector 35 has been removed. Now C1 may be shorted and L2 removed. This configuration has the advantage that the electrodes used to collect ions do not have any AC voltages applied to them.

This configuration can be further modified by physically replacing electrode 100 by a flat metal strip wound around envelope 13 so as to constitute coil L1. In this embodiment, electrode 100 becomes identical to coil L1.

The gas filling the torus can be varied according to particular requirements, one of which is the desired wavelength distribution of the radiation. It may contain at least one rare gas or at least two rare gases. Further, it may contain at least one rare and one halogen containing compound.

The material from which the torus is constructed is a dielectric such as glass, quartz, purified $SiO_2$, Pyrex, Potash glass, or of an alkali metal resistant glass such as 1720 glass, 1723 glass and Gehlinite.

The window itself may be sealed to the torus by a sealing compound which may be selected from the list consisting of epoxy resins, Silvac or AgCl/Ag pair, or a low melting sealing glass.

Figure 3:
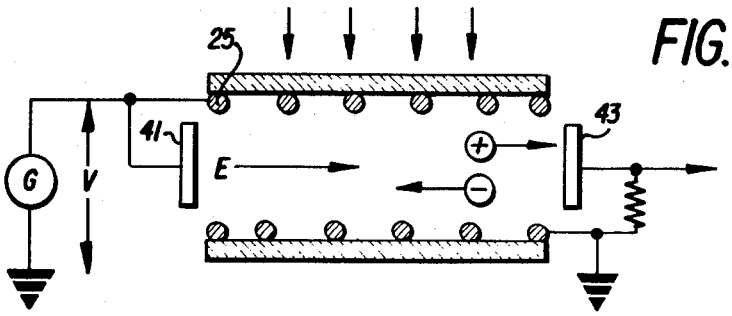
FIG. 3 is a schematic illustration of the interaction between the electrodes and the electric fields relating thereto.

Turning now to FIG. 3, there is shown a schematic illustration of the operation and the effects thereof within the passageway of the torus of a different electrode structure. The downward decending arrows indicate the discharge which occurs from the torus. A current generator G is connected to both the helical electrode 25 and, in this illustrative case, electrode 41. The resulting current in the helix establishes a uniform electric field along the axis of the electrode structure. This electric field causes the positive ions to pass in the direction as shown to the ground electrode 43 and the negative ions to pass in the reverse direction. The output from electrode 43 is connected to the electrometer. Accordingly, the resulting output to the electrometer will be indicative of the characteristics and the amount of the particular gas which is being examined. This usually is done at a high sample gas pressure. Electrodes 41 and 43 must permit gas to flow through them and, so, are of a mesh or grid structure.

If electrode 43 is as described, or is a ring or short cylinder adjacent to the torus wall, and the sample gas pressure is low, ions will be extracted from the ionization region and projected along the electrical system axis. If the electrode 43 is complex so as to form an ion lens, the ions will be formed into an image at some distant point.

FIG. 4 shows another and simpler electrode configuration. The discharge (vertical arrows) occurs between the outside ground electrode 201 and cylindrical electrode 204 when AC generator 202 is operating. When DC generator 203 applies a positive potential to electrode 204, positive ions are repelled to wire electrode 209 where they are collected and measured by an electrometer (not shown) after the AC signal is removed by coil L11 and capacitor C11.

There are several variations in the size, shape, and positioning of the ion collection electrodes. These variations are meant to facilitate manufacture or assembly, to reduce photoelectron currents from the electrodes, to optimize the discharge in the light source, to minimize interference of the AC potential in the measuring of the ion currents, or to optimize the extraction and/or focusing of ions from the ionization region.

FIG. 5 shows a configuration in which the electodes causing the discharge in the torus (47 and 110) are physically different from the electrodes (204, 209 or 41, 25 and 43) used for collection or extraction of ions from the region illuminated by the light source. In this case, there is less need for decoupling the ion collection potentials since they are coupled only indirectly by the capacitance between the separate electrode structures.

Electrode 47, in conjunction with one of the other electrodes, if it is grounded, can be used to cause a discharge inside the sample gas so as to create free radicals for cleaning deposits from surfaces. Additionally, a discharge can be generated between electrodes 47 and 48.

FIG. 6 illustrates one of the many configurations which the torus may assume. This can be formed easily in the process of making the device, and any particular configuration may be obtained from a practical standpoint.

Figure 7:
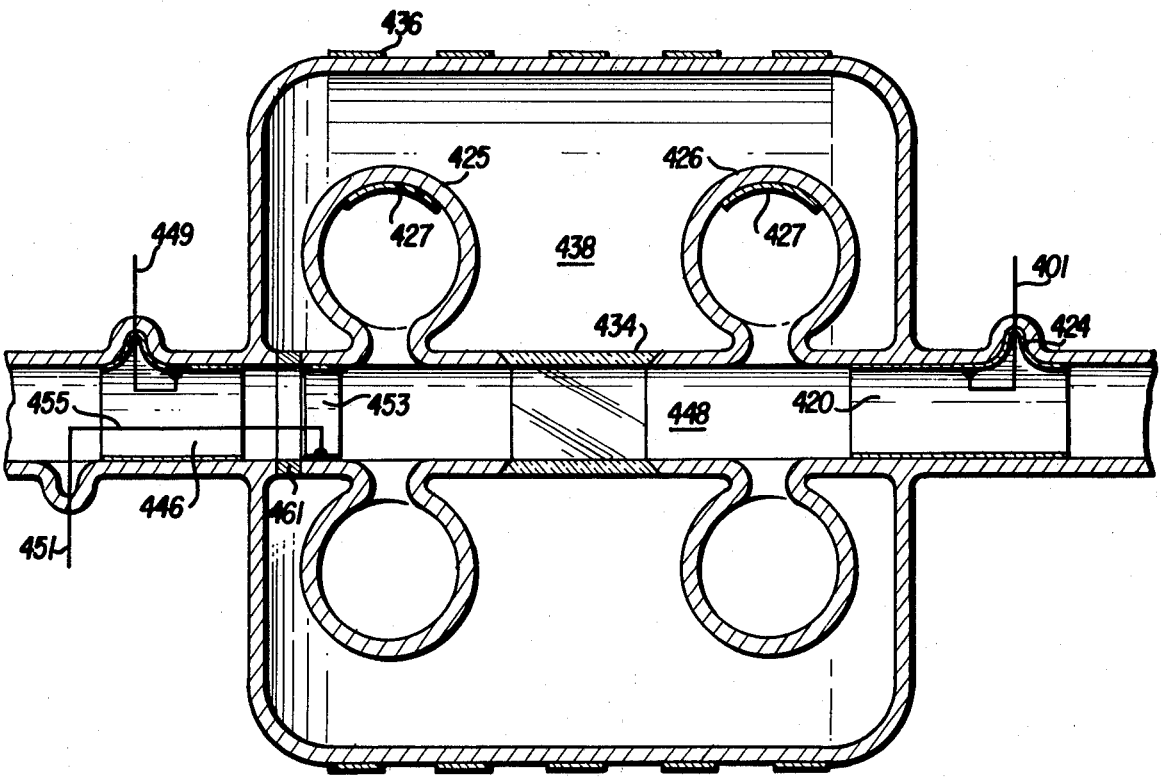
FIG. 7 is a schematic illustration of a modification of FIG. 1 showing means for separating surface currents from volume ion currents.

FIG. 7 shows an embodiment in which part of the surface conduction path is shielded from UV or VUV illumination by forming self-shielding corrugations in its shape. This same figure indicates how a conductive film (guard electrode) could be applied and connected so as to bypass the current paths from ion collection electrodes to its measuring device. Although, surface currents flow, they are not measured by the device which measure the currents which flow in the fluid within the ionization region. Not shown, but easily invisioned, are electrodes mounted on insulating mounts so as to increase the length of surface current path and so decrease its conductivity until it becomes unimportant.

Referring specifically to FIG. 7, tungsten or platinum feed through 401 is a metal wire passing through the glass wall and making contact with platinum paint electrode 420 which would normally be the anode. Platinum paint 424 around this feed through provides an alternative means of contacting it. Corrugations 425 and 426 do not need to be of precise dimensions so long as a small region such as 427 is shadowed from UV or VUV radiation passing through the $MgF_2$ window 434. Platinum film electrodes 436 may completely surround the Kr gas filled space 438 and be connected to a AC high voltage source to cause a discharge in the Kr gas as it can be in the form of a coil, as shown, formed from flat strips and replace coil L1 in FIG. 2. Window 434 may be sealed to the glass with a AgCl seal. This may be accomplished by coating both sides of the proposed seal with platinum and melting (near 450° C.) the AgCl to flow over these surfaces to form a seal. Alternatively, a silver segment may be employed between the window and the glass tube forming part of the central gas passageway. Other sealing methods such as special glass slurries may be employed.

Cathode 446 as shown in FIG. 7 may be a platinum film coating a portion of the entire central gas passageway 448 and in contact with feed through 449, (which is identical to feed through 401) by way of a platinum film strip so that electrode 451 is not contacted.

A guard ring electrode 453 is shown on the window side of electrode 446 to intercept surface currents which are then conducted to feed through 451 by means of connection 455 which may be a wire or conducting film if it can bypass electrode 446 either by passing over it (after applying an insulating film on electrode 446 where it passes) or by configuring electrode 446 so as to leave a passageway for a platinum film strip to reach electrode 451.

Also shown is a non-photoconducting material 461 which can also serve to prevent the surface currents from reaching the central electrode 446. All these devices are not used simultaneously and are shown together in FIG. 7 for economy of exposition. For example, no current would reach the guard electrode 453 if corrugations 425 and 426 are present or non conducting material 461 are present.

FIG. 7 does not show the getter side arm or the source side arm which may be required and which would then be used.

The corrugations 425 and 426 can also serve another important purpose by relieving the stress generated because of the mismatch of thermal expansion coefficients of the VUV window 434 and the material of the discharge bulb it is attached to. The flexure of the corrugations compensate for this mismatch. An alternative configuration would put the corrugations on the outer surface of the envelope. This configuration has the advantage that there are no "backwaters" in the sample flow path which would disturb the measurement of its content. Such exterior corrugations, although not shown in other figures, should be considered present if needed by the thermal characteristics of the material of the VUV window and the bulb envelope.

FIGS. 8 through 11 show a preferred modification of the device of FIG. 1 which employs the method as described in FIG. 7 wherein the central gas passageway 500 and conduit 501 have been modified but all other components of the device remain substantially the same.

In this embodiment, $MgF_2$ window 503 is shown as thicker and projecting into the central gas passageway. It is shown sealed to the material of the passageway by a AgCl seal 504, but any other method of fabrication could be used. Anode 505, is again a platinum film strip although many other means of forming it could be employed; for example, it could be a thin stamped metal insert. Anode 505 is connected to feed through 510 by a platinum film, but other means (such as a wire) are also possible. The feed through is a sealed wire passing through the material of the central gas passageway and can be identical to those shown in FIG. 7.

Figure 8:
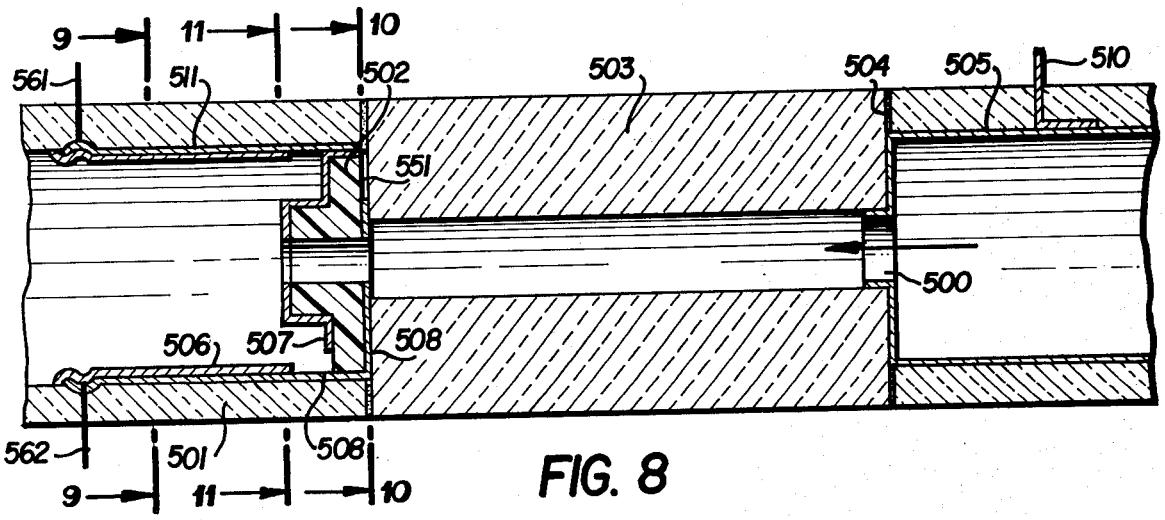
FIGS. 8 and 9 are modified schematics of the embodiment of FIG. 1.

The cathode in FIG. 8 is a press fit composite unit 550 (not shown) which buts against the projection of window 503 and guard electrode 508 and consists of 507 and 502 and shields cathode surface 507 from radiation passing through window 503 and insulates cathode surface 507 from surface guard ring 508 which is a platinum film strip on the inner edge of the window 503 projection into the central gas passageway. Cathode surface 507 contacts platinum film conductor strip 511 by a pressure contact between the conducting parts 507 and 511 which in turn contacts feed through 561. Guard electrode 508 contacts feed through 562. The orientation of cathode insert 550 prevents cathode surface 507 from being in contact with guard electrode 508 or its extension to feed through 562. Theportion of the conducting films, 511 and 508, used to reach feed throughs 561 and 562 which are somewhat removed from cathode insert 550 are coated with an insulating film 506 to prevent photoelectron emission. The extent of the window 503 projection into the central gas passageway 500 may be much less than shown or absent altogether. All components can be altered if they perform the functions alloted to them.

Figure 9:
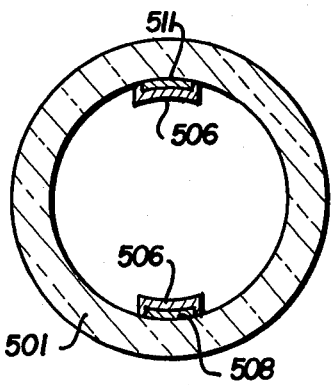
Figure 10:
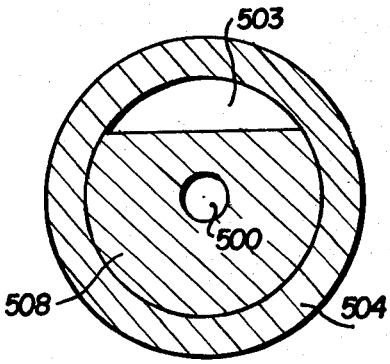
FIGS. 10 and 11 are cross-section areas taken along the lines 10—10 and 11—11 of FIG. 8.
Figure 11:
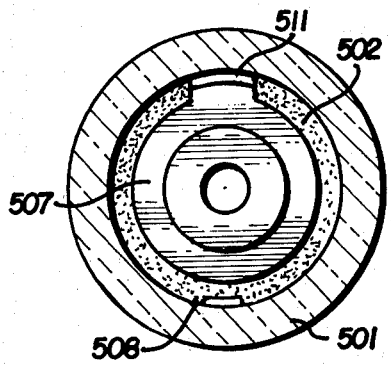

FIGS. 9, 10 and 11 show these details more clearly.

Figure 12:
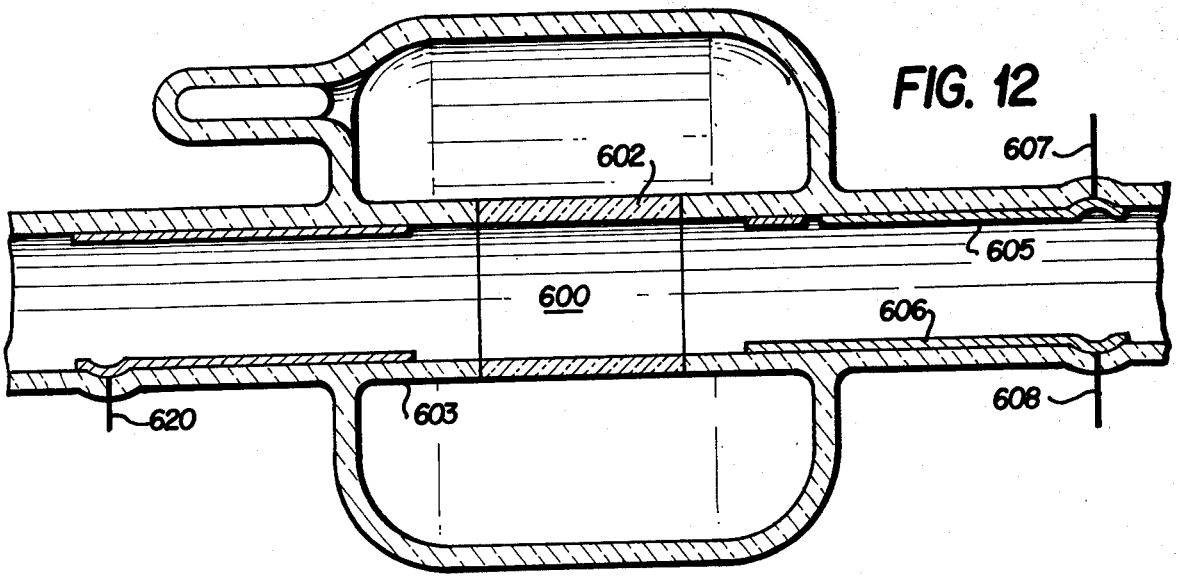
FIG. 12 is a simplified schematic of the embodiment of FIG. 8.

FIG. 12 is a diagrammatic illustration of a simpler version of the device of FIG. 8 which does not attempt to shield the cathode from UV and VUV radiation passing through $MgF_2$ window.

The central gas passageway 600 contains, in order proceding from left to right, an electrical feed through 620 connected to anode 601 on the glass wall 603 of the passageway, $MgF_2$ window 602, guard electrode 606, connected to feed through 608, cathode 605 connected to feed through 607. A getter arm 601 is also illustrated.

As to the getter, various materials may be used such as processed barium azide, barium metal or sintered metal. Further, if radiation characteristics of species other than the rare gas is required, this species can be generated by thermal decomposition of $UrH_3$, $UrD_3$, $KMnO_4$, $LiN_3$, $ZnCO_3$, $CuS0_4.nH_2O$, $AuCl_3$, $AuI_3$, and $AuBr_3$ or as disclosed in the referenced patents.

The heater can take many configurations and is schematically illustrated as a simple electric heater. However, it would preferably be a metal-film-on-plastic or ceramic resistor with a heat conducting material held in place by means such as a teflon shrink sleeve and/or an outer-inner insulating layer held in place by a second teflon shrink sleeve. Any means which accomplishes the thermal decomposition is satisfactory, but selection would be governed primarily by size and weight.

It is obvious that any type of structural support may be used for retaining the device of the present invention in position, so long as it does not affect the electrical characteristics or block the gas or the discharge in the torus.

The above description and drawings are illustrative only since equivalents may be substituted for various components described. Accordingly, the invention is to be limited only by the scope of the following claims.

I claim:

1. A photoionizer comprising a light source comprising a hollow torus;

a UV or VUV transmitting window in said torus, said window comprising part of the inner wall of said torus;

a gas filling within said torus, said gas filling being a pressure between $10^{-3}$ and $10^3$ torr;

means for creating an electrical discharge within said torus;

means for passing a preselected gas sample through a passage in said torus;

electrode means within said passage through said torus for collecting or extracting the ions and electrons produced by the light from said light source striking said gas sample;

means connected to said means within said passage for measuring the ions and electrons collected by said electrode means; and means adjacent said passage for preventing surface currents along the surface of said hollow torus from reaching said electrode means.

2. The photoionizer of claim 1 wherein said means adjacent said passage are employed to intercept or prevent surface currents from reaching the ion collecting electrode which is attached to the ion measuring means.

3. The photoionizer of claim 1 wherein said means for preventing surface currents from reaching said electrode comprises a structure which prevents UV or VUV radiation from striking a portion of the inner surface of said passage.

4. The photoionizer of claim 1 wherein said means for interrupting surface currents comprises a material interposed in the surface conducting path of said hollow torus which does not conduct when illuminated with UV or VUV radiation.

5. The photoionizer of claim 1 wherein said means for interrupting surface currents comprise a guard electrode for intercepting surface current before it reaches said ion collection electrode means.

* * * * *